US005834721A

United States Patent [19]

Østergaard et al.

[11] Patent Number: 5,834,721

[45] Date of Patent: Nov. 10, 1998

[54] COUPLING- AND SWITCH SYSTEM FOR SUBSEA ELECTRICAL POWER DISTRIBUTION

[75] Inventors: Inge Østergaard, Heggedal; Arne Nysveen, Borgen, both of Norway

[73] Assignee: ABB Offshore Technology AS, Billingstad, Norway

[21] Appl. No.: 762,460

[22] Filed: Dec. 9, 1996

[30] Foreign Application Priority Data

Nov. 13, 1996 [NO] Norway ..... 964821

[51] Int. Cl.[6] ..... H01R 4/60

[52] U.S. Cl. ..... 200/81 R; 439/201

[58] Field of Search ..... 200/51 R, 82 R, 200/51.07–51.09, 51.11–51.13, 318, 321, 322, 61.13, 61.14, 61.19, 81 R, 81.4, 82 B, 82 A; 439/32, 131, 132, 196, 197, 199, 201, 259, 286, 139, 140, 186

[56] References Cited

U.S. PATENT DOCUMENTS

| | | | |
|---|---|---|---|
| 3,383,480 | 5/1968 | Phillips et al. | 200/51 |
| 3,469,044 | 9/1969 | Dickerson | 200/51.07 |
| 3,599,167 | 8/1971 | Adrian et al. | 439/186 |
| 3,843,853 | 10/1974 | Panek et al. | 200/51.09 |
| 4,346,954 | 8/1982 | Appling | 439/201 |
| 5,645,438 | 7/1997 | Cairns | 439/201 |
| 5,645,442 | 7/1997 | Cairns | 439/201 |

FOREIGN PATENT DOCUMENTS

| | | | |
|---|---|---|---|
| 2 037 498 | 7/1980 | United Kingdom | H01R 3/00 |

*Primary Examiner*—Michael A. Friedhofer
*Attorney, Agent, or Firm*—Wenderoth, Lind & Ponack, LLP

[57] ABSTRACT

A coupling and switch system for subsea electrical power distribution employs fluid-filled contact housings. The coupling and switch system includes two mutually spaced contact housings mounted along a common centerline. A space between the contact housing has therein a coupling housing or middle piece having contact elements. The middle piece when or after mounting between the contact housings is anchored in a fluid-tight manner thereto by axial movement of one or both contact housings. The contact elements of the middle piece can be moved into respective contact housings with the middle piece in the mounted position.

13 Claims, 10 Drawing Sheets

COUPLING- AND SWITCH SYSTEM FOR SUBSEA ELECTRICAL POWER DISTRIBUTION

BACKGROUND OF THE INVENTION

The invention relates to a coupling and switch system having one or several through-going electrical conductors, substantially for subsea connection of a single or multiphase high voltage system.

A typical application of a coupling and switch system is a three phase high voltage connection in the range of 1–36 kV or higher, for example, on connection with coupling of subsea transformators, further electrical operation of pumps for reinjection of separated water, in addition to operation of other electrical equipment located on a sea bed. The coupling and switch system has an electrical disconnecting function (disconnecting switch) which can be used for in situ or remotely operated, temporary or permanent coupling and uncoupling of different electrical parts to and from each other.

Development within offshore oil and gas exploration in the recent years has been directed to subsea installations for processing and transport of oil and gas. These subsea installations are increasingly replacing the traditional platforms in which oil and gas was transported up to the platform for further processing and transport, for example. This development of subsea production, processing and transport systems has resulted in an increasing need for the supply of large quantities of electrical power. The combination of electrical power (high voltage) and salt water results in the coupling of electrical cables, for example to other electrical equipment on the sea bottom and specially the operation thereof over time, being very difficult and dangerous, and hence is a substantial challenge for the development of technology within this area. A typical area of use for the present invention is a subsea system (installation) for separation of water from crude oil in which supplied hydraulic or electrical power is required in order to facilitate reinjection of separated water by operation of injection pumps. Electrical power must be supplied through an electrical system facilitating high voltage transfer from a surface installation to the subsea installation.

Coupling devices for the above object presently are substantially based on liquid filled couplings comprising a male part and a female part. During connection the male part is kept steady and the female part is moved against and in coupling engagement with the male part manually or by use of external tools. It has been experienced that the female part is the weak part in this coupling, and water ingress over a period of time is a problem, resulting in that this type of coupling has a limited operational life.

Examples of this prior art technique are disclosed in EP 48601, EP 0251655, EP 493375, WO 9016095 and GB 2124038.

SUMMARY OF THE INVENTION

The primary object of the present invention is to provide an improved coupling and switch system, which provides improved safety against water ingress and thereby extended operational life of the system in use.

A further object of the invention is to provide such a system which is simple to service and which preferably includes a replaceable coupling unit.

A further object of the invention has been to provide a coupling system which can be utilized as a coupling system and as a switch system for one or several through going electrical conductors.

A further object has been to provide a coupling and switching system which is particularly suited for high voltage applications, for example 1–36 kV or higher.

The invention is based on a coupling system comprising two mutually paced contactor housings mounted along a common center line, with a coupling housing or so-called middle piece or part provided within a space between the contactor housings. The middle piece has contacting elements which can be moved into contact with the respective contactor housings. After mounting of the middle piece between the contactor housings, such elements are anchored in a liquid-proof manner by axial movement of one or both contactor housings, since the middle piece is provided with contactor elements which can be moved into the respective contactor housings with the middle piece in the mounted position.

The middle piece may be released and retrieved from the mounted position between the contactor housings by pulling the middle piece away from a center line through the housings, when one or both of the housings is (are) released axially from the middle piece. The middle piece and the contactor housings are provided with a channel system that is connected when the middle piece and contactor housings are in the mounted position, thus facilitating flushing of the coupling system in the connected position.

The coupling and switch system according to the present invention has a robust and sturdy construction wherein contacting areas between the male and female parts in a controlled manner are cleaned of sea water, etc. and are supplied with dielectric fluid for operation. The coupling further includes a replaceable female part with a switching function. By the coupling according to the invention, thereby is achieved a sea water-proof coupling having a switching function and good serviceability.

BRIEF DESCRIPTION OF THE DRAWINGS

The present invention is explained below by reference to the attached drawings, wherein.

DETAILED DESCRIPTION OF THE INVENTION

Figure 1:
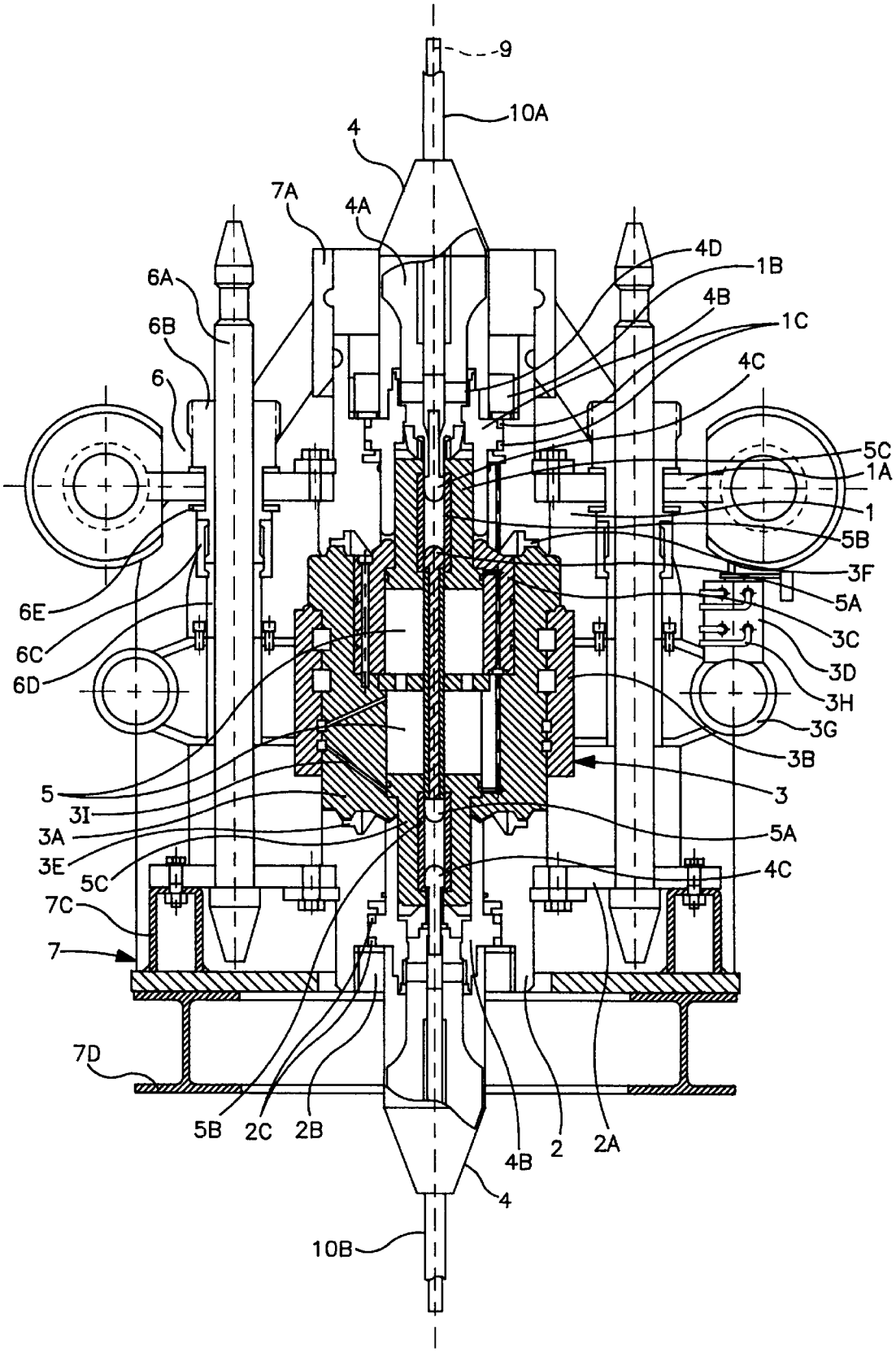
FIG. 1 is a partially sectional view showing a coupling and switch system according to the invention in an assembled operational state.

With reference to the drawings and particularly to FIG. 1, an embodiment of a coupling and switch system includes two opposing coupling flanges 1, 2 each having a built-in electrical male part 4 with a contact pin 4C and a middle piece 3 having opposite built-in electrical female parts in the form of sleeves 5B with respective contact pins 5A.

These elements are arranged in a back-to-back telescopic manner. The middle piece 3 can be installed and disconnected/replaced by using a remote operated vessel (ROV). In the assembled state, the assembly including upper flanges 1, middle piece 3 and lower flange 2 forms a container from which entrapped seawater can be flushed and replaced by a proper medium. After flushing, the telescopic structure of the middle piece 3 is activated, such that each electrical female part 5B hydraulically is pushed into engagement with the respective electrical male part 4C built-in the upper flange 1 and the lower flange 2. The flanges 1, 2 can be arranged in a vertical or horizontal arrangement.

The coupling device according to the present invention can be utilized wherein all phases (three) of an electrical cable are connected by means of respective assemblies, i.e. one assembly per phase. Hence, the electrical female part 5B typically includes three pins, one for each of the three phases, instead of one pin as shown in the drawings.

Below is a designation of the components shown in the drawings. An upper vertical assembly includes upper flange 1, locking plate 1A, nut 1B and metal sealing rings (radial) 1C. A lower vertical assembly includes lower flange 2, locking plate 2A, nut 2B and metal sealing rings (radial) 2C. A middle female assembly includes the middle piece 3, flushing housing 3A for fluid I/fluid II/fluid III, flushing housing ring 3B, flushing nozzle 3C, ROV valve 3D, metal sealing ring 3E for the flange 2, metal sealing ring 3F for the flange 1, manifold/funnel 3G, pipe system 3H (typically four pipes) and channels 31. Male electrical connector parts each include male part 4, penetrator 4A, contact housing 4B, contact pin 4C and metal sealing ring (axial) 4D. A female electrical coupling part includes chambers 5, contact pin 5A, and shuttles or sleeves 5B in compensation pistons 5C in chambers 5. Tension bolts 6 each include bolt 6A, adjustment nuts 6B, split sleeve 6C, bolt housing 6D and thrust bearing 6E. Fixedly mounted frame 7 includes upper framing 7A including a locking ring with a ROV (part of an upper module) lower framing 7B (part of a lower module), stamped member 7C, and frame lower part 7D. The entire system has a upper cable 10A and lower cable 10B are connected to male parts 4.

Examples of the above mentioned fluids are, for fluid I: distillated water, etc., for fluid II: hydroscopic liquid, methanol, synthetic oils, etc., for fluid III: dielectric fluid for example silicon oil, synthetic oils, etc. In addition, more than one ROV valve could be included.

The middle piece 3 and tensioning bolts 6 form an assembly which can be installed or disconnected/replaced by using a ROV. It should be noted that the remote operated vessel including tools thereof is not shown in the drawings, but such tools will perform functions related to transport, guiding, and adjusting, in addition to tensioning of the tension bolts 6. Such equipment represents prior art technique and therefore is not discussed. A flushing system for injection of cleaned fluid I/fluid II/fluid III for dedicated, built-in tanks or closed dry/cleaning circuit or fluid I/fluid II/fluid III is also included in the system. Underpressure in relation to the surrounding environment can be used to effect circulation of any of the above fluids.

Figure 2:
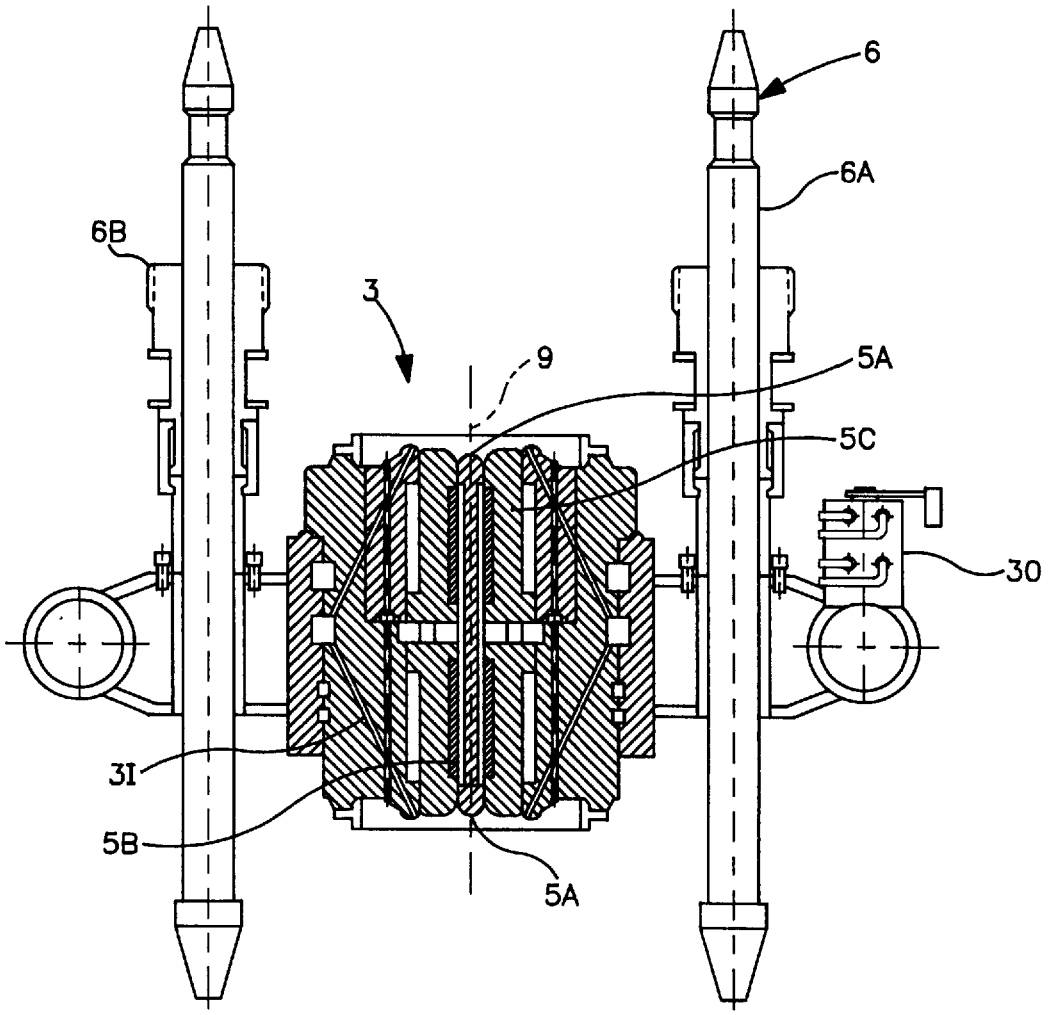
FIG. 2 is a similar view showing a middle or female part to be inserted into the coupling in the manner of FIG. 1.
Figure 3:
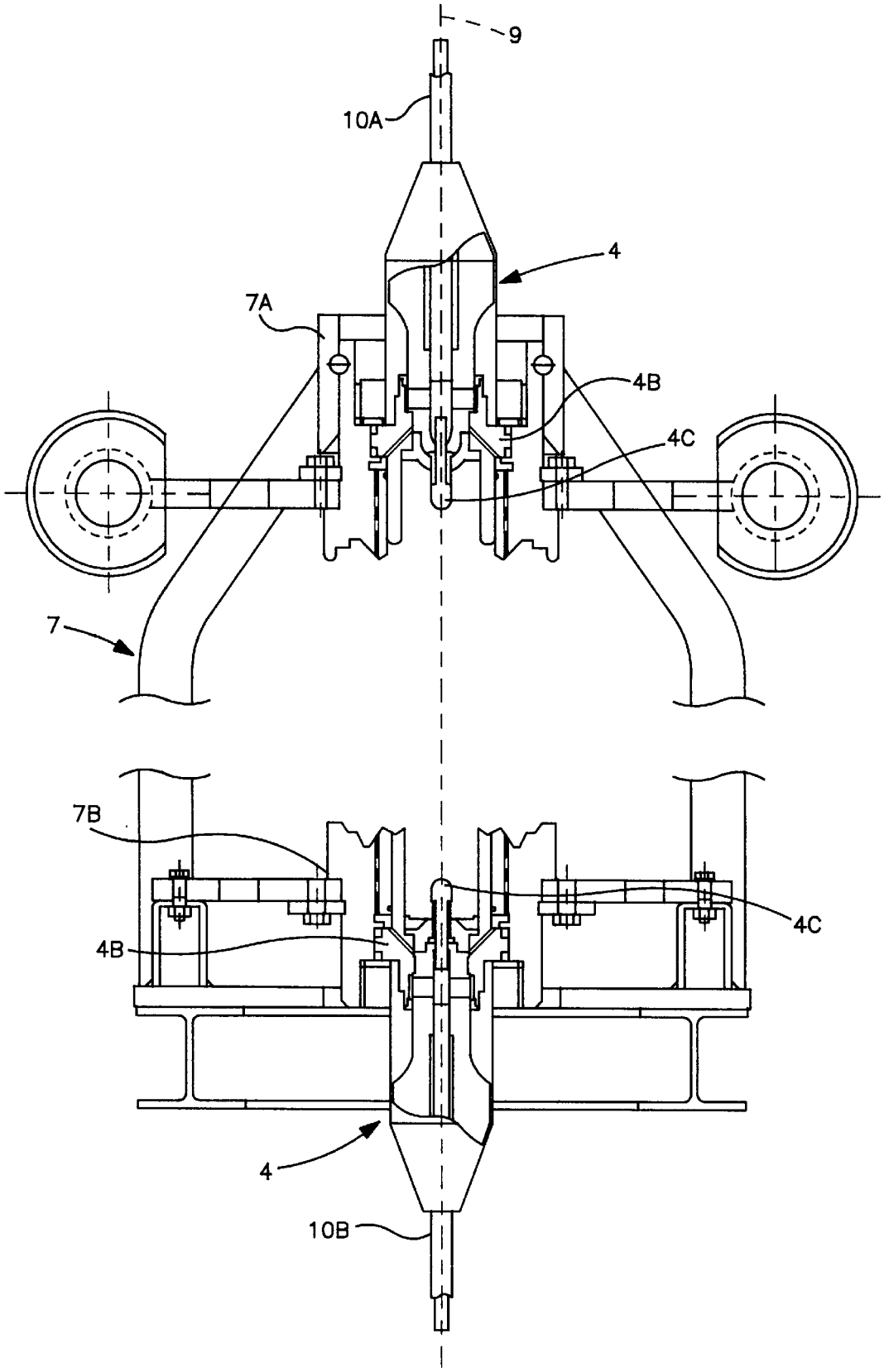
FIG. 3 is an elevation view showing a male part of the coupling and provided on a frame or skid.
Figure 4B:
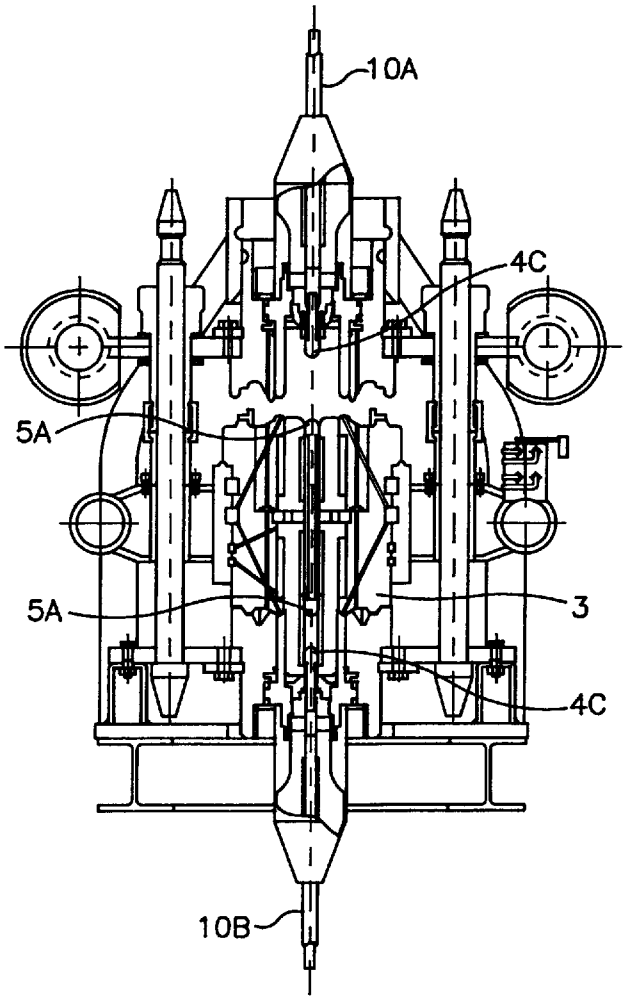
FIGS. 4*a*–4*h* show steps for coupling the coupling and switch system.
Figure 4A:
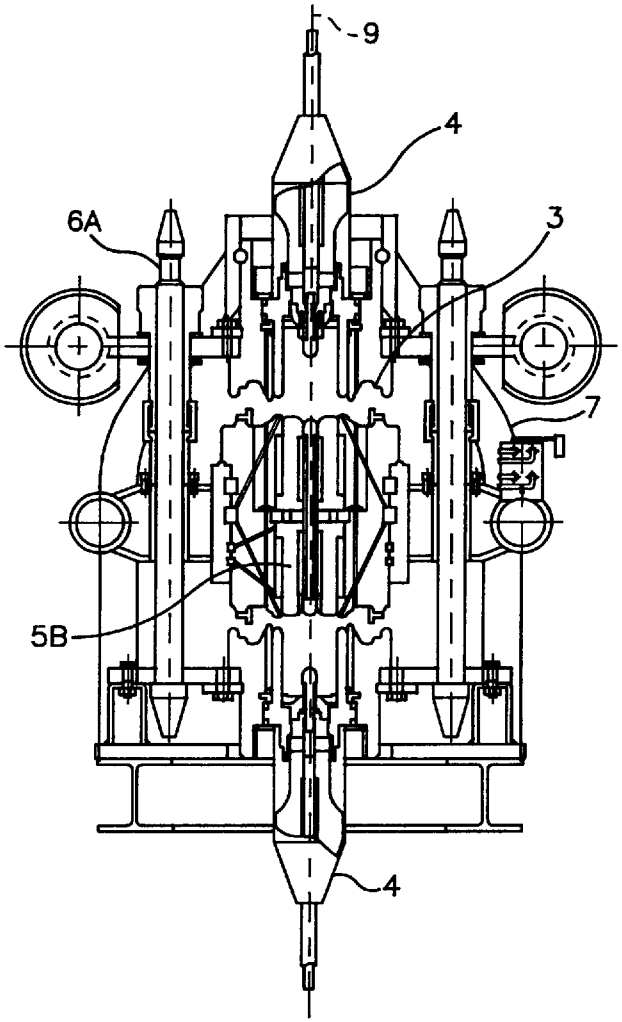

With reference to FIGS. 4*a*–4*h* a sequence for connecting the coupling and switch system according to the invention now will be described. FIG. 4*a* shows the electrical male coupling parts 4 arranged on an assembly forming frame 7 and opposingly located in axial alignment and with a space therebetween. The assembly of frame 7 and the male parts having mounted thereon the respective upper cable 10A and the lower cable 10B typically will be located on the sea bottom. FIG. 3 shows such assembly of the coupling prior to inserting the middle piece 3. In FIG. 2 the middle piece 3 including tensioning bolts 6 is shown in a separated state. FIG. 4*a* further shows the middle piece 3 including bolts 6A and a hydraulic activating system. The middle piece 3 including bolts 6A is inserted by means of a ROV.

Figure 4D:
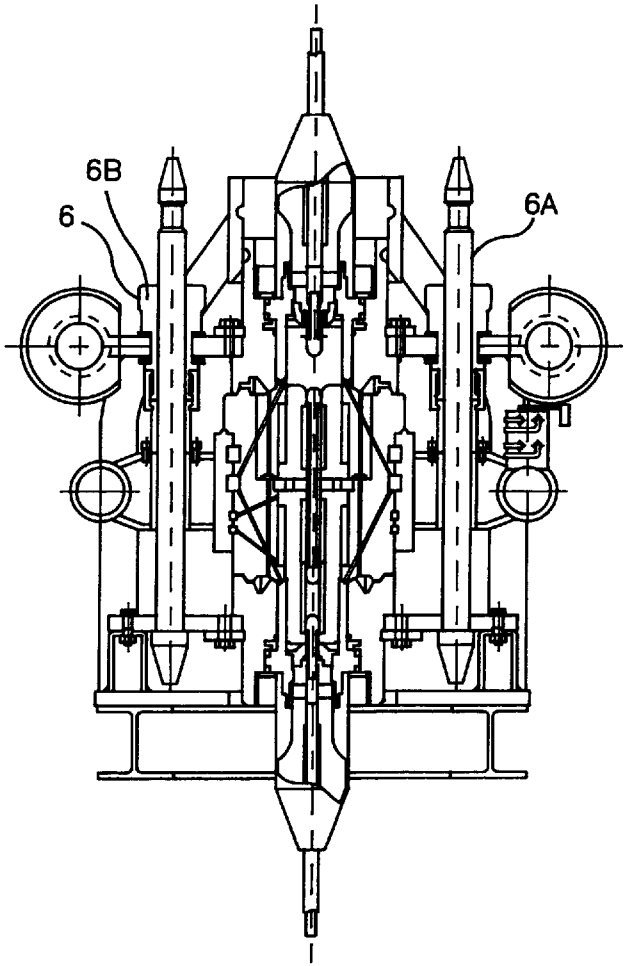
Figure 4C:
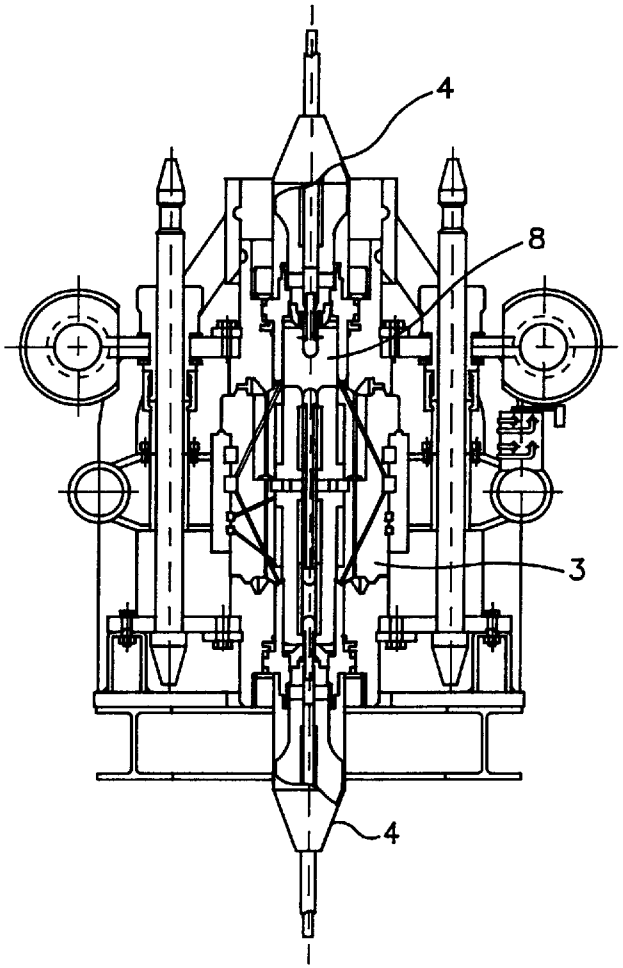
Figure 4J:
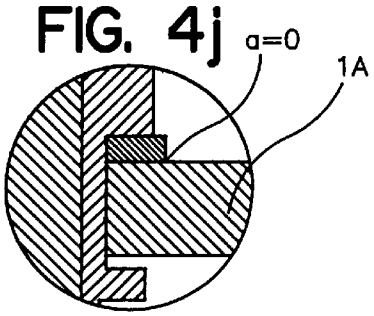
FIGS. 4*i*–4*k* are enlarged views of portions of FIGS. 4*e*–4*g*, respectively.
Figure 4F:
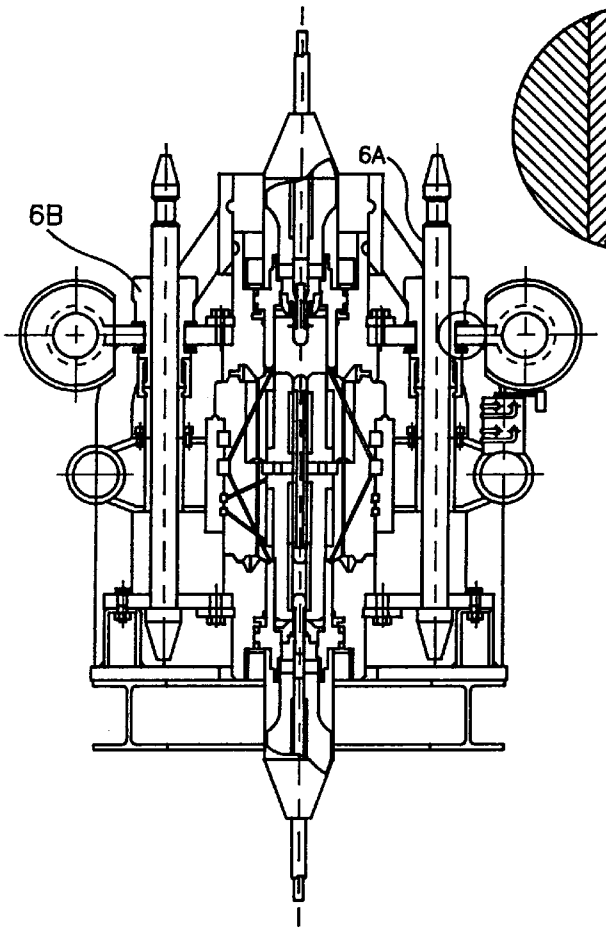
Figure 4I:
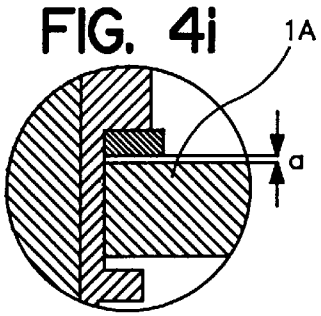
Figure 4E:
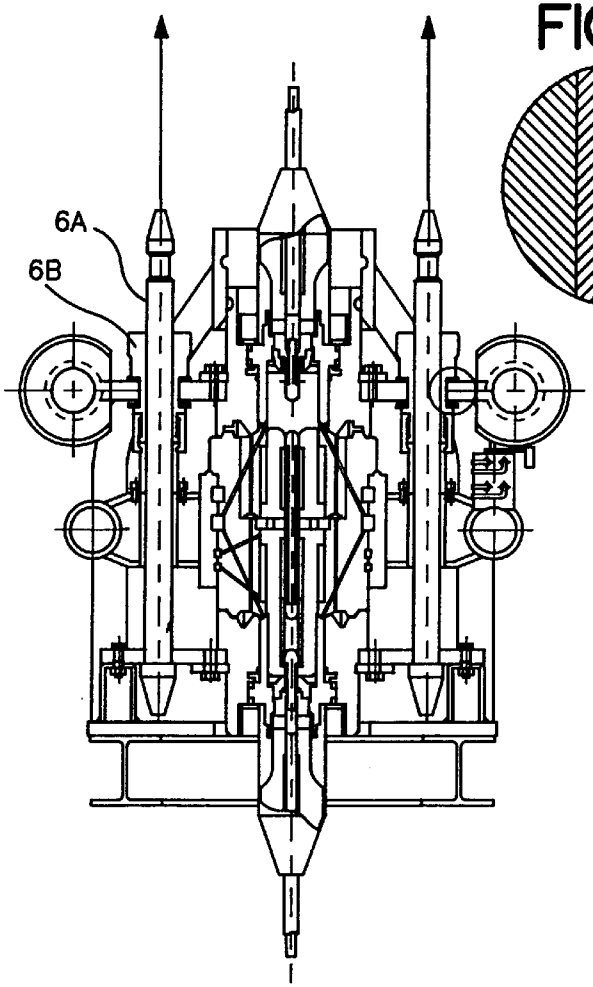
Figures 4G, 4H, 4K:
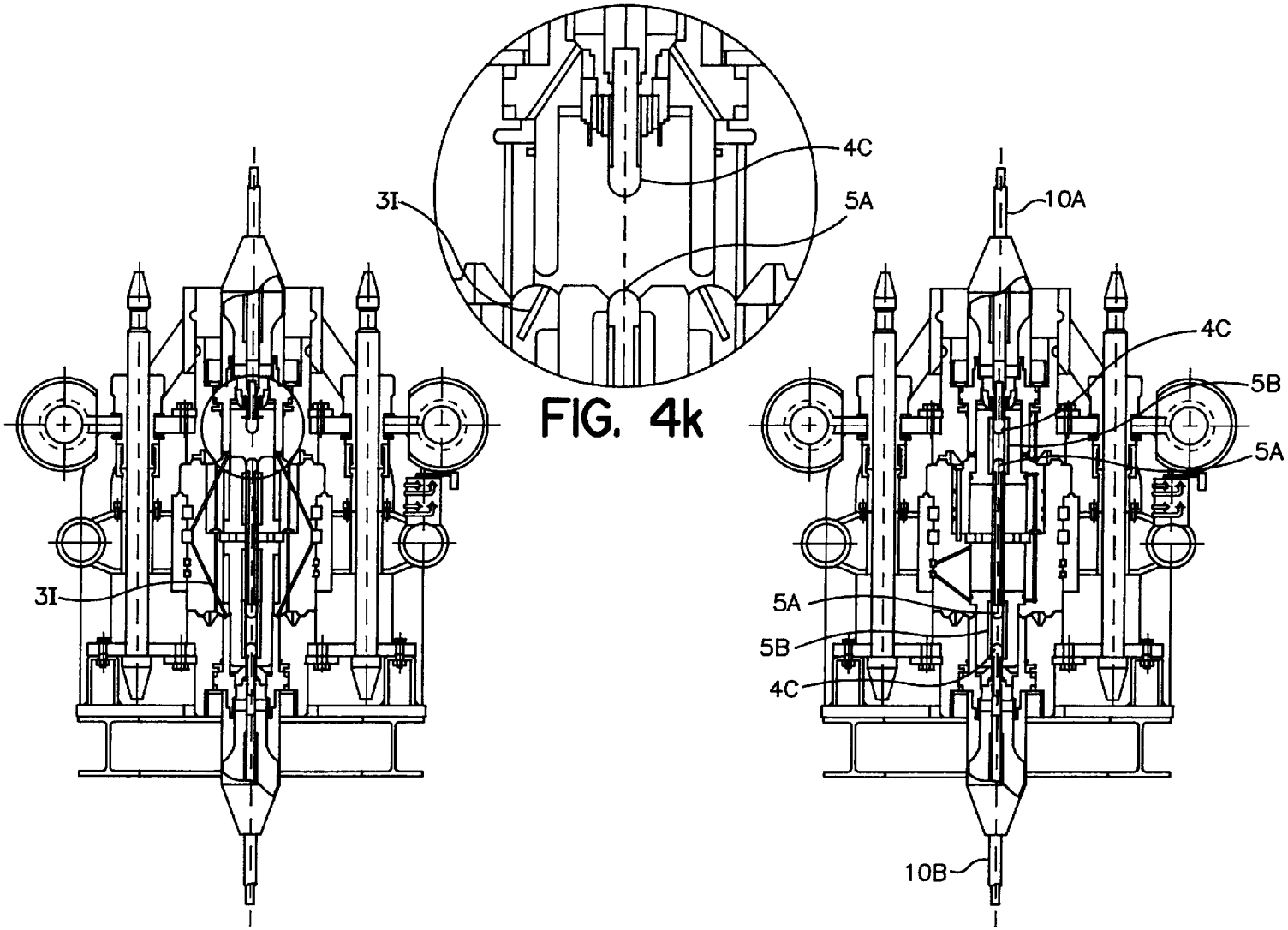

FIG. 4*b* shows the middle piece 3 lowered down against the lower male part 4. In this position a small gap between such two parts will still exist. FIG. 4*c* shows the next step in the operation, wherein the upper male part 4 now is lowered down against the middle piece 3, and a small gap between such two parts also will still exist. In FIG. 4*d* the bolts 5A are lifted somewhat upwardly. In FIG. 4*e* the bolts are tensioned, and a gap a is provided (FIG. 4*i*). In FIG. 4*f* the nuts 6B are tensioned, such that the gap a is closed (FIG. 4*j*). FIGS. 4*g* and 4*k* show the operation of flushing of the resultant enclosed chamber by means of fluid I/II/III. FIG. 4*h* shows the electrical connection completed between the female and the male parts by the female parts being moved axially outwardly to bring sleeves 5B into engagement with the contact pins 4C, of the hydraulic activation of pistons 5C in chambers 5.

Figure 5B:
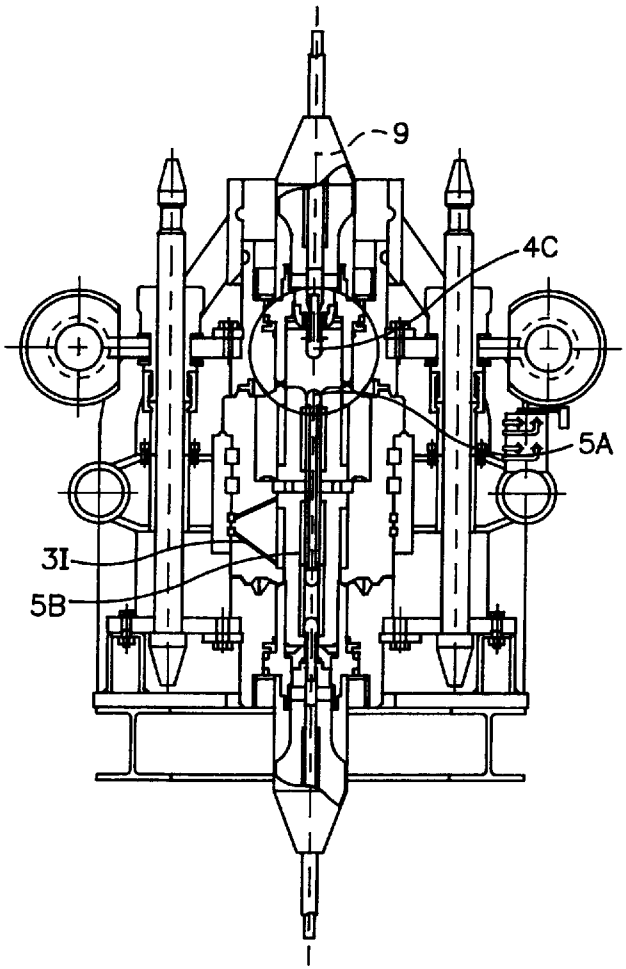
FIGS. 5*a*–5*f* show stepwise a disconnecting/switching function of the coupling and switch system according to the invention.
Figure 5A:
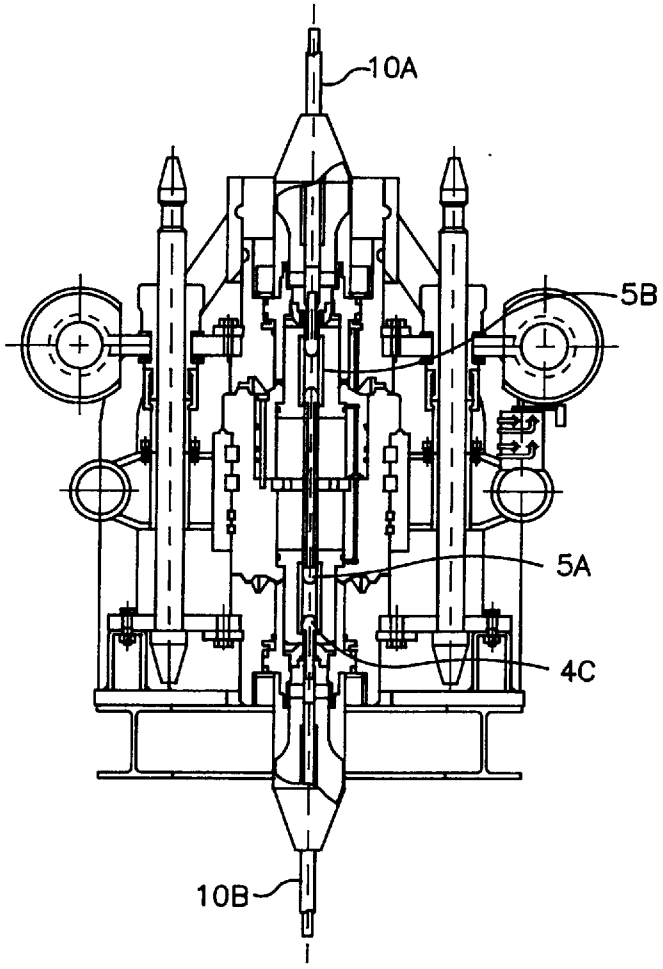
Figure 5D:
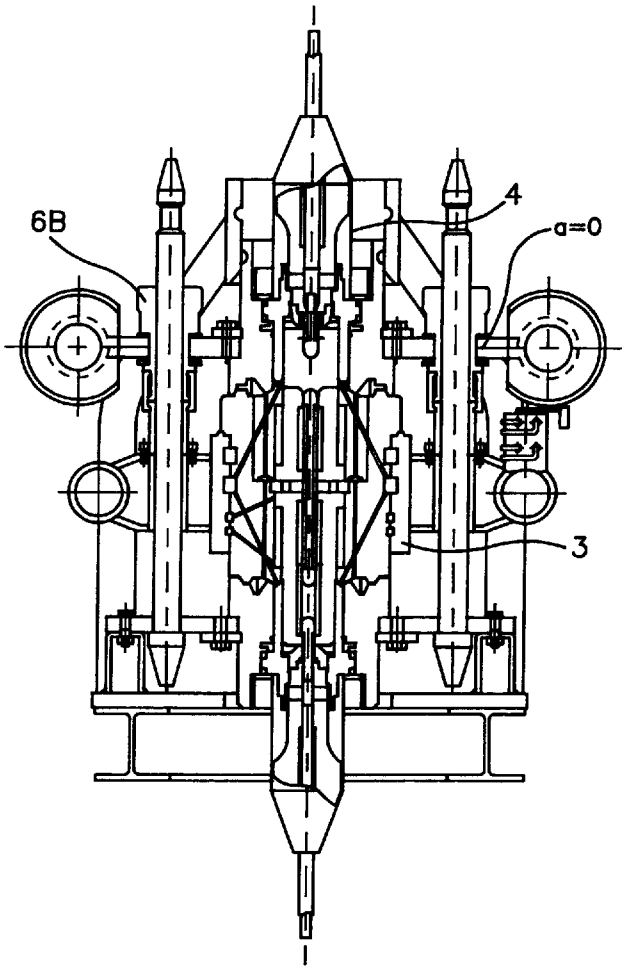
Figure 5C:
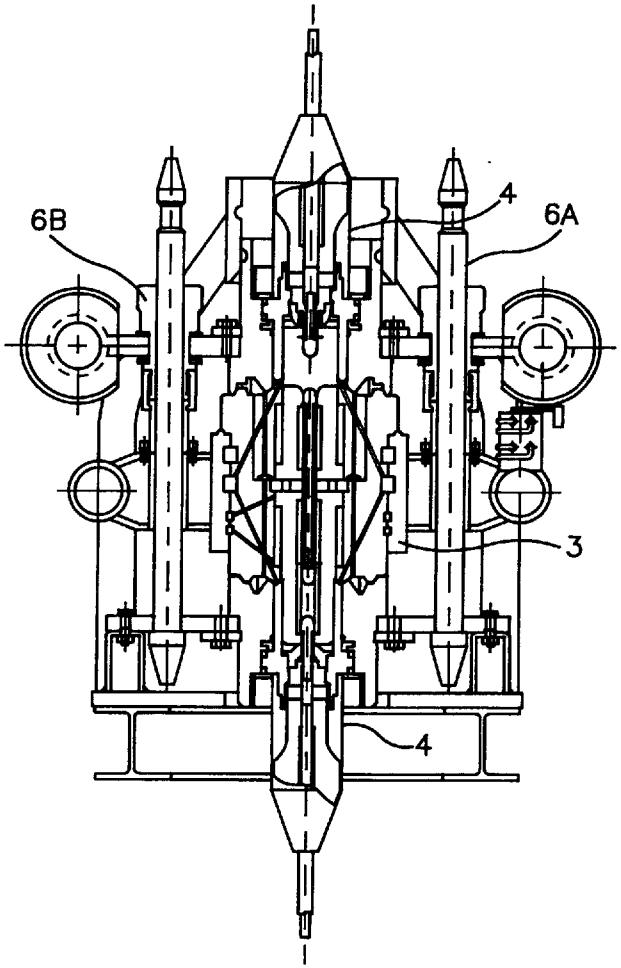
Figure 5F:
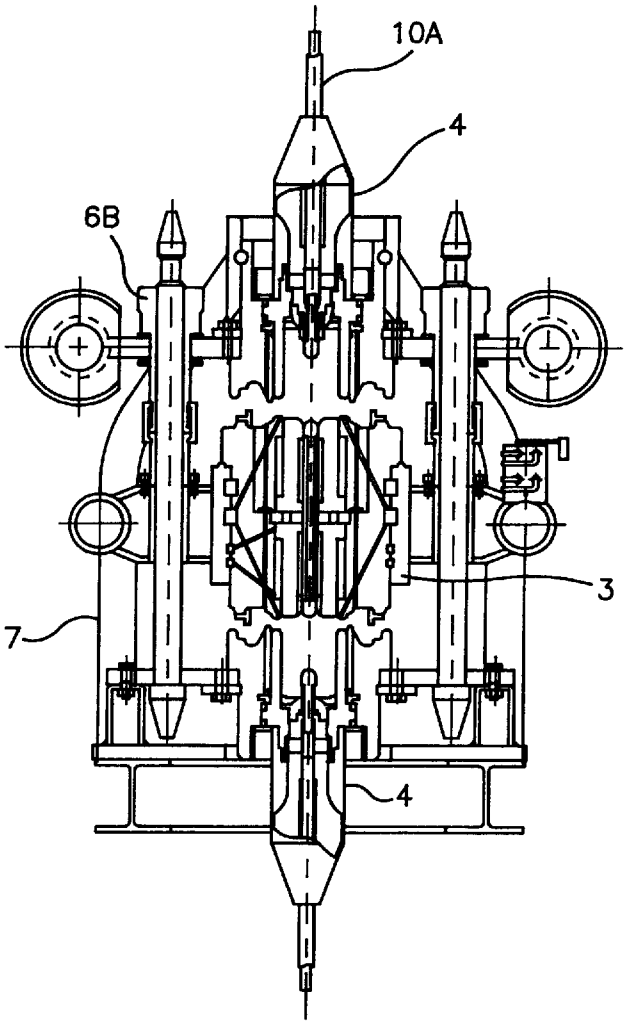
Figure 5E:
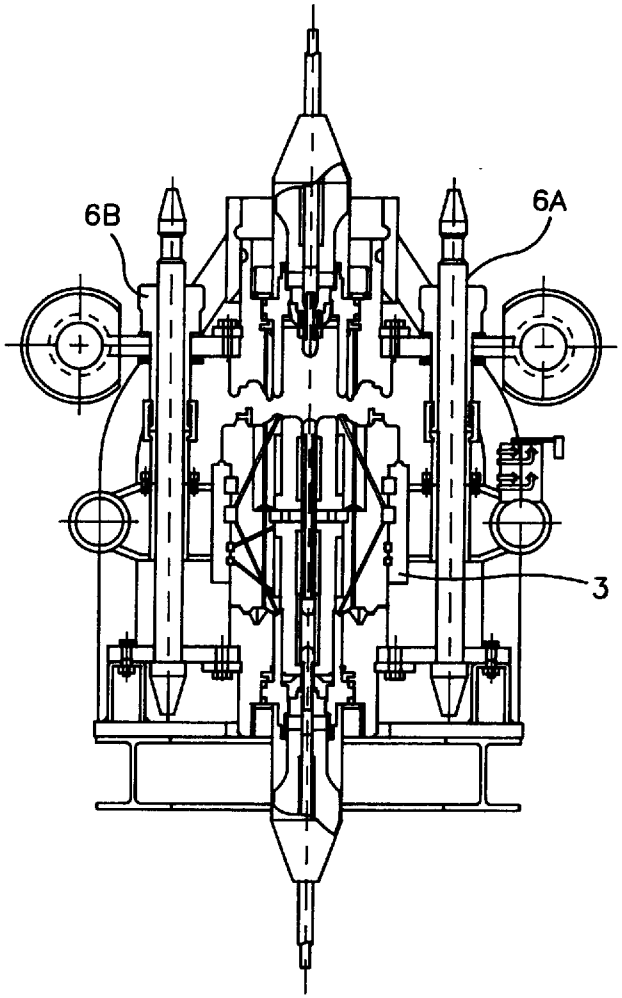

In FIGS. 5*a*–5*f* a sequence of disconnecting the coupling and switch system according to the present invention is shown. FIG. 5*a* shows the coupling and switch system in a completely assembled state, and the power supply is turned or switched off. In FIG. 5*b* electrical disconnection is achieved in that sleeves 5B are moved axially from contact pins 4C by hydraulic power. FIG. 5*c* shows disconnection of the bolts being started. In FIG. 5*d* lifting of the upper male part 4 is commenced. In FIG. 5*e* the lifting of the upper male part 4 is completed and the lifting of the middle piece 3 is commenced. In FIG. 5*f* the middle piece 3 is completely released and ready to be taken out by the tool of the ROV and brought to the surface. The middle piece 3 can be used as an electrical disconnecting switch by reversing the coupling sequence with the result as shown in FIG. 5*b*. Then the electrical cables 10A, 10B temporarily or permanently can be separated from each other without the coupling being opened to sea water. Thereafter one cable, 10A for example, can be put under voltage, however on the assumption that the gap between the contact pin 5A and the male part (in the end 10B) is sufficient to prevent arcing when the voltage is turned on.

The coupling and switch system according to the present invention has a robust, service-friendly and a very safe, high integrity structure, especially regarding ingress of sea water during electrical interconnection, in addition to preventing ingress of water during service life. The coupling system is very flexible, and in a distribution system on the sea bed for example, it can be preferably to electrically switch off parts of the system in periods, and this is achieved in a simple manner as explained with reference to FIGS. 5*a*–5*b*. As explained with reference to FIGS. 5*a*–5*f*, the system is very service-friendly and the parts with the traditionally highest failure rate (the female parts, middle piece 3) can be disconnected and brought to the surface for service operations.

A common problem with any interconnection system is how interconnection movement can be achieved. The coupling arrangement according to the invention has a solution wherein a very reduced motion from the upper flange 1 which has a built-in electrical mail part 4 is utilized, and this is achieved with respect to a middle piece 3 having telescopically provided electrical female parts in the form of sleeves 5B that can be retracted and that are located between the upper and lower flanges 1, 2. The members can be activated by a ROV, such that an internal movement of the middle piece 3 provides electrical coupling to statically supported electrical male parts.

Electrical couplings for connection in sea water have been based on direct interconnection of male and female parts in sea water. This is due to limited diver capacity during, or assistance to, the interconnection itself. The system according to the invention provides a solution wherein this process is mechanized. A closed metallic sealable tank is created prior to the interconnection, in order to discharge entrapped sea water prior to the interconnection between the male and female parts. Thus, interconnection can be carried out in an environment which is friendly in relation to ensuring isolation and to prevent sea water ingress. Replacement of sea water within the coupling is achieved, prior to interconnection, by a forced circulation between two chambers which are separated by an elastomer seal or O-ring. A first chamber is a male part or pocket having a circulation ability completely in the bottom, and a second chamber is a collection chamber representing a sea water barrier. Circulation is achieved via the ROV frame/manifold which is built into side mounted funnels (manifold in the one funnel) of the middle piece. The form of flushing ports and the manifold are optimized based on fluid mechanical analyses where turbulent flow in the male part or pocket will be optimized. The flushing function, for example, is coupled to one or several closed circuits in the ROV skid (tool). In order to improve the replacement of entrapped sea water in the middle piece, discontinuous flushing can be achieved by temporarily creating an under-pressure which is used to suck out sea water, and thereby suck in fluid I, II and III in turn. Therefore, the electrical coupling itself is carried out in fluid III, i.e. dielectric fluid.

After flushing is completed the electrical connection itself will be hydraulically effected by the ROV skid or tool, through the hydraulic manifold in the side-mounted funnel 3G of the middle piece 3. The telescopic coupling consists of two electrical female parts in back-to-back arrangement, each of which substantially is an electrical conducting sleeve or contact. These are moved outwardly by hydraulic power such that electrical contact with static contacts or pins in electrical male parts is achieved. The current or electrical power path from live cable 10A in the upper male part 4, for example, will be through the male pin 4C to the female sleeve 5B of the movable part or shuttle, and therefrom to the contactor pin 5A of the female part, electrically isolated from the chamber wall of housing 3A, and further to the sleeve 5B of the lower female part, and therefrom to the lower contactor pin 4C of the male part, and finally to the cable 10B.

It should be noted that the sleeve typically is constructed with flexible contact elements at each end to establish safe electrical coupling with contactor pin 5A and the male part contactor pin 4C.

Previous experience shows that the electrical female parts are less reliable than the male parts. This is due both to the unavoidable complexity in that the female parts include dynamic elastomer type gaskets, and in that wiper/drying rings are exposed to wear with the following possibility of causing water ingress. The present solution is characterized in that the electrical female parts are replaceable since they are telescopic. The middle piece includes such telescopic coupling, the side-mounted funnels and the tensioning bolts. This results in an arrangement which in its entirely can be replaced by means of a ROV/ROV-skid. This is a substantial difference compared with traditional solutions, wherein a first or second module must include a female part that is built in permanent part and that is replaceable only by replacement of the module.

In connection with electrical contacts, it is a known problem that the contact points can be exposed to wear and additionally that wear can be originated due to particle expulsion during arcing. The present coupling and switch system provides the male parts with replaceable electrical contacts. These are provided by means of a principal often utilized in the subsea industry in order to make it possible to correct errors if damage has occurred on a coupling flange, for example. Replacement of male part electrical contacts is carried out with a special middle piece functioning as a tool for the contacts. After bringing old contacts to the surface, the special middle piece is charged with new contacts, which later are located in position by reversing the disconnecting/retrieval procedures.

In the attached drawings the coupling system according to the invention is shown for horizontal insertion of the middle piece. Another alternative would be vertical insertion of the middle piece, as a middle piece between two flanges containing male parts, referred to as horizontal, intermodular coupling. A closed circulation circuit for removal of sea water within the middle piece prior to electrical coupling, as described above, can be utilized.

The present invention provides that the piston 5C includes an arrangement in which an isolating material immediately surrounds the electrical conducting sleeve 5B, in addition to the fact that electrical isolation may be achieved by the piston 5C being manufactured of a non-conducting material. It is possible to include compensation chambers in the pistons 5C which can be filled with fluid III.

There exist today limited experience with high voltage electrical couplings, interconnected in sea water. Experience has shown that couplings having substantially low voltage, i.e. 200–400 V, have started to lose isolation resistance after a varying time in the sea water, typically 6 to 18 months. Small amounts of water left after coupling cannot explain this tendency, and the industry has made the conclusion that water absorption/leakage related to non-metallic material exposed to hydrostatic pressure probably is the case. An object of the present solution is to limit water ingress by completely isolating the vital electrical components from sea water by use of metal seals (gaskets). The present coupling system includes the following seals provided with metal-to-metal connections: at each end of the middle piece 3, securing of the male parts to the middle piece, separating the middle piece, at metallic welds, hydraulic communication from manifold in funnel by use of pipe system, in addition to metal seat valves used for disconnecting of the same pipe system. A complete and consequent replacement of the elastomer seals with metallic seals is one of the characterizing features of the present coupling and switch system.

It was previously known that use of tensioning bolts is a more rational way to pretension bolts in a flange connection. The present solution utilizes this principal and enables weight reduction. The solution utilizes two bolts symmetrically located on each side to pretension the assembly of flange 1, middle piece 3 and flange 2. For corresponding two bolts solutions which utilize tensioning of nuts, the need to synchronizing two rotating actuators, such as hydraulic motors/planet gears, is evident. These can be achieved by an intermediate mechanical gear mechanically coupling the two hydraulic motors. This solution involves substantial weight, and therefore is not suited for applications in which the ROV carries the tool (skid). Therefore, the present solution includes pretensioning of the bolts directly, and synchronizing is achieved in a very simple way by tensioning cylinders parallelly coupled to the pressure side, which results in equalized, even pressure for pretensioning of the bolts.

Axial joining (pin and shuttle) reduces the danger of forces existing in connection with electrical live elements in a magnetic field, which is effected by conducting parts, leading to disconnection. This provides structural provisions ensuring a forcewise (magnetically induced force) imbalance resulting in a driving effect causing the shuttles to maintain connected positions. This is intentionally done by controlling the magnetic field at the contact points. Further, enclosed hydraulic volume (metallic seals) will provide hydraulic locking, which prevents undesired disconnection during service.

We claim:

1. A coupling and switch system for use in subsea electrical power distribution, said system comprising:

first and second contact housings mounted along a common centerline with a space between said first and second contact housings, said first and second contact housings having respective contacts;

a middle coupling housing removably positionable in a mounted position in said space, said coupling housing having contact elements aligned with respective said contacts of said first and second contact housings when said coupling housing is in said mounted position;

at least one said contact housing being movable along said centerline toward said coupling housing when said coupling housing is in said mounted position, to thereby anchor said coupling housing in a fluid-tight manner to said first and second contact housings; and said contact elements being mounted for movement toward and into electrical contact with said respective contacts of said first and second contact housings.

2. A system as claimed in claim 1, further comprising a frame supporting said first and second contact housings.

3. A system as claimed in claim 2, wherein said at least one contact housing is supported by said frame for movement along said centerline.

4. A system as claimed in claim 3, wherein both said first and second contact housings are supported by said frame for movement along said centerline.

5. A system as claimed in claim 2, wherein said coupling housing includes bolt assemblies extending parallel to said centerline and mountable on said frame.

6. A system as claimed in claim 1, wherein said coupling housing has therein at least one chamber having mounted therein first and second pistons supporting respective said contact elements, whereby movement of said pistons achieves said movement of said contact elements.

7. A system as claimed in claim 6, wherein said first and second pistons are mounted in respective first and second chambers in said coupling housing.

8. A system as claimed in claim 6, wherein each said contact element includes a contact sleeve mounted in a respective said piston.

9. A system as claimed in claim 8, wherein said contacts comprise contact pins mounted in respective said contact housings, and said movement of said pistons moves said contact sleeves into positions surrounding and in electrical contact with respective said contact pins.

10. A system as claimed in claim 9, wherein said contact elements include further contact pins mounted in said coupling housing and surrounded by respective said contact sleeves.

11. A system as claimed in claim 6, wherein said coupling housing has therein fluid channels for supplying hydraulic fluid to said at least one chamber to provide movement therein of said first and second pistons.

12. A system as claimed in claim 11, wherein said coupling housing includes a flushing system for flushing entrained sea water through said fluid channels.

13. A system as claimed in claim 12, wherein said flushing system is operable to supply dielectric fluid through said fluid channels.

* * * * *